United States Patent [19]

Gray et al.

[11] Patent Number: 4,862,123

[45] Date of Patent: Aug. 29, 1989

[54] SOLENOID FOR ELECTRIC STARTERS

[75] Inventors: Ronald N. Gray; Raymond O. Butler, Jr., both of Anderson, Ind.

[73] Assignee: General Motors Corporation, Detroit, Mich.

[21] Appl. No.: 190,625

[22] Filed: May 5, 1988

[51] Int. Cl.[4] ..... H01H 67/02

[52] U.S. Cl. ..... 335/131; 335/126

[58] Field of Search ..... 335/126, 131, 202, 255, 335/83

[56] References Cited

U.S. PATENT DOCUMENTS

| | | | |
|---|---|---|---|
| 3,134,932 | 5/1964 | Ray . | |
| 3,273,086 | 9/1966 | Eberline et al. . | |
| 3,571,770 | 3/1971 | Dew . | |
| 3,611,218 | 10/1971 | Fujita . | |
| 3,848,206 | 11/1974 | Prouty et al. . | |
| 4,038,623 | 7/1977 | Kamp et al. | 335/196 |
| 4,156,220 | 5/1979 | Mazzorana . | |
| 4,251,788 | 2/1981 | Barthruff et al. . | |
| 4,262,546 | 4/1981 | Mazzorana . | |
| 4,293,835 | 10/1987 | Davis et al. . | |
| 4,382,242 | 5/1983 | Colvin et al. . | |
| 4,404,533 | 9/1983 | Kurihara et al. . | |
| 4,450,423 | 5/1984 | Morishita . | |
| 4,540,962 | 9/1985 | Grescey et al. . | |
| 4,579,010 | 4/1986 | Colvin et al. . | |
| 4,604,597 | 8/1986 | Bogner et al. . | |
| 4,637,267 | 1/1987 | Mazzorana . | |

*Primary Examiner*—E. A. Goldberg
*Assistant Examiner*—Lincoln Donovan
*Attorney, Agent, or Firm*—C. R. Meland

[57] ABSTRACT

A solenoid for an electric starter. The solenoid has a metal case that contains a coil winding assembly. The coil winding assembly includes a plastic coil spool that carries a pull-in coil and a hold-in coil. One end of the coil spool supports a plurality of axially extending metallic threaded studs that are insert molded into the end of the coil spool. The end leads of the coils are wrapped around the studs and welded thereto. The studs, together with nuts that are threaded onto the threaded portions of studs, serve to secure a plastic cover to an end of the metal case.

3 Claims, 1 Drawing Sheet

SOLENOID FOR ELECTRIC STARTERS

This invention relates to solenoids and more particularly to solenoids for an electric starter.

Solenoids for electric starters that have a case and coil assembly and a cover assembly that is secured to the case and coil assembly are well known to those skilled in the art. Examples of such solenoids are disclosed in the U.S. patents to Gresley et al. 4,540,962 and to Colvin et al. 4,382,242. In the solenoids of the type described, some means must be provided to secure the cover assembly to the case and coil assembly. In the Colvin et al. patent this is accomplished by the use of cover retention screws that are threaded into mounting studs that are supported by a steel plate. In the Gresley et al. patent the case and cover are secured together by forming a portion of the case over a surface of the cover.

It is also known to use fasteners to form electrical connections between the interior and exterior of a solenoid housing where the fasteners also perform some fastening function. Thus, the United States patent to Ray 3,134.932 discloses so-called binding posts which connect the interior and exterior of a solenoid housing and which further serve to fasten a strip of insulation in place. The binding posts of Ray are not insert molded into the coil spool. It is further known to provide the fastener arrangement shown in the Ray patent to secure a cover of a starter solenoid to a case and coil assembly where the fasteners also provide electrical connections between the interior and exterior of a solenoid. This invention, like the prior art mentioned above, provides a fastening means for securing the cover to the case which also serves as an electrical connector means for forming an electrical connection between the coil or coils of the solenoid and the exterior of the cover. However, the solenoid of this invention differs from the above-mentioned prior art in that the fastening means is insert molded into the coil spool. Thus, the solenoid of this invention has a coil assembly wherein a plastic coil spool carries one or more coil windings and a plurality of metallic threaded terminal studs that are insert molded into the spool. The end leads of the solenoid coil or coils are wrapped around the studs and welded thereto. The cover is attached to the case by passing the studs through openings in the cover and then applying nuts to the threaded portions of the studs to thereby tightly fasten the cover to the case. The studs accordingly operate as electrical connectors and as a fastening means for securing the cover to the case.

Another object of this invention is to provide a solenoid of the type described that has a steel end plate that provides a flux path and a register for the solenoid cover.

IN THE DRAWINGS

Figure 1:
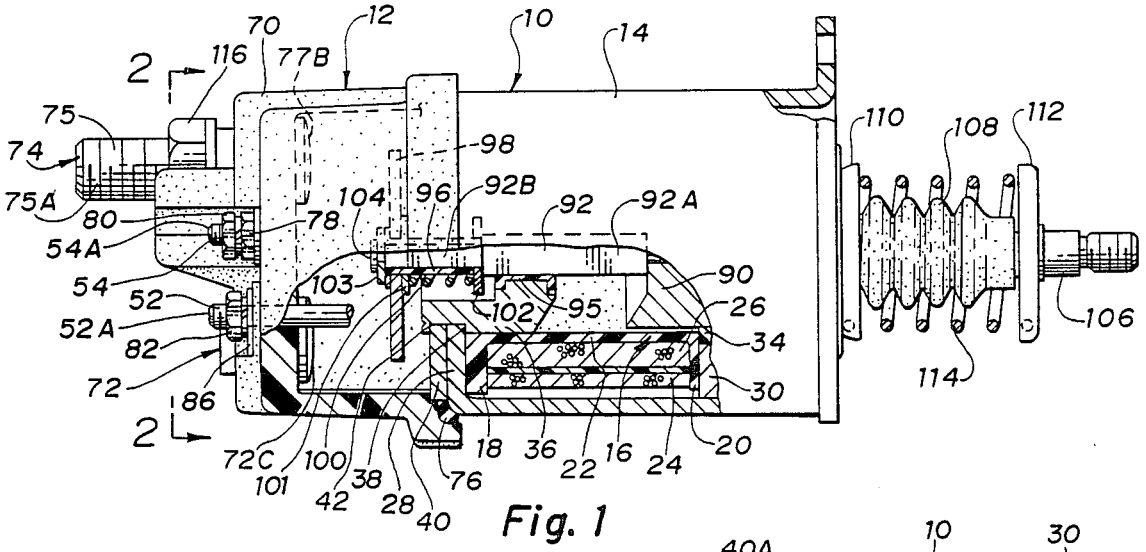
FIG. 1 is a side view with parts broken away of a starter solenoid made in accordance with this invention.

Referring now to the drawings, and more particularly to FIG. 1, a starter solenoid is illustrated that has a case and coil assembly 10. The case and coil assembly 10 is secured to a cover assembly 12 in a manner that will be described.

The case and coil assembly 10 comprises a tubular steel case 14. The case 14 supports a coil winding assembly which is comprised of a spool or coil winding support 16 that is formed of plastic insulating material. The coil support 16 has flanges 18 and 20 and a tubular portion 22. The spool or coil winding support 16 carries a hold-in coil 24 and a pull-in coil 26 which are comprised of a number of turns of wire.

The coil winding assembly is clamped between an end wall 28 of case 14 and a steel end plate 30. The end plate 30 is secured to the case 14 by staking in portions of the case 14. One of the staked in portions is shown and designated by reference numeral 32. The end plate 30 carries a bearing bushing 34, which as will be more fully described hereinafter, slidably supports the armature or plunger of the solenoid. The bushing 34 is formed of a plastic bearing material such as nylon. The case and coil assembly 10 further includes a steel plunger stop 36. The plunger stop has an annular surface 38 which engages a portion of the case 14. A steel end plate 40 engages the plunger stop 36 and a portion of case 14. The end plate 40 has a circular outer surface 40A. Since the plate 40 is formed of magnetic material it provides a path for flux that is developed when coils 24 and 26 are energized. The plunger stop 36 is staked-in over areas designated as 42 to thereby secure the plunger stop 36 and plate 40 to an end of case 14.

Figure 4:
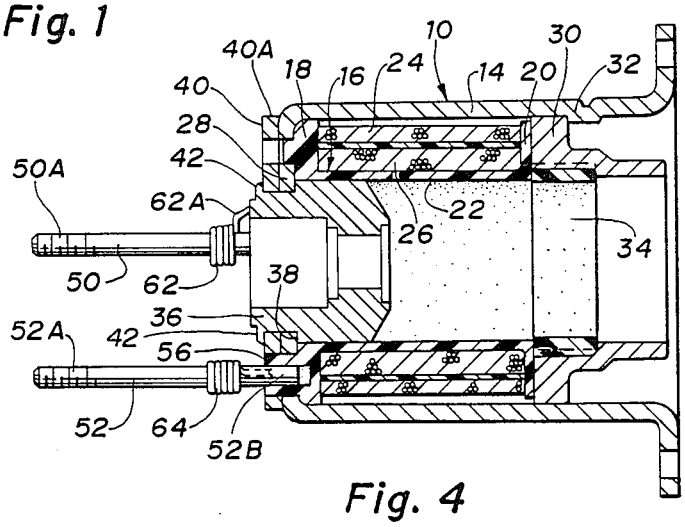
FIG. 4 is a sectional view taken along line 4—4 of FIG. 3.
Figure 3:
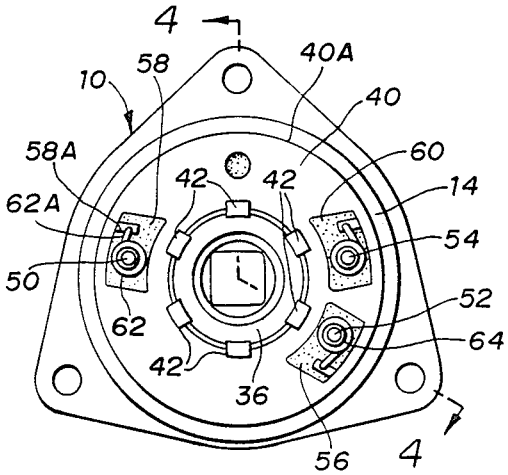
FIG. 3 is an end view of a case and coil assembly that forms a part of the solenoid shown in FIG. 1.

The case and coil assembly 10 has three steel terminal studs designated respectively by reference numerals 50, 52 and 54. Each terminal stud has a threaded portion 50A, 52A and 54A. All of these studs have one end thereof molded into portions of the coil spool 16 so that the studs are supported by the spool. As can be seen in FIG. 4, the end 52B of terminal stud 52 is insert molded into portion 56 of spool 16. In a similar fashion, the ends of terminal studs 50 and 54 are insert molded into portions 58 and 60 of spool 16. The portions 56, 58 and 60 of spool 16 extend through openings formed in the end plate 40 and in the end wall 28 of case 14.

As will be more fully described hereinafter the terminal studs 50, 52 and 54 serve to secure the cover assembly 12 to the case 10 and also serve to form electrical connections or terminations for the pull-in and hold-in coils 26 and 24. Thus, one end lead or terminating conductor of the hold-in coil 24 is electrically connected to stud 50. This is shown in FIG. 4 where a terminating end of hold-in coil 24 is shown wrapped around a portion of terminal stud 50. This wrapped around portion is designated by reference numeral 62 and the wrapped coils 62 are welded to terminal stud 50. The lead 62A that is the end or terminating lead of one side of hold-in coil 24 extends through a slot 58A. The conductor portion 62 that is welded to terminal stud 50 may be for example the outside lead of the hold-in coil 24. In a similar fashion, the outside end lead of the pull-in coil 26 is electrically connected to terminal stud 52 by wrapping the end of this lead around terminal stud 52 and welding this portion to the terminal stud 52. The welded coil portion just referred to is designated by reference numeral 64.

The terminal stud 54 is electrically connected to the inside lead end of the pull-in coil 26 and to the inside lead end of the hold-in coil 24 by wrapping the end leads around terminal stud 54 and welding these portions to the terminal stud 54 in a manner that has been described in connection with the welding of wrapped coils to the terminal studs 50 and 52.

The terminal stud 54 may be termed a switch terminal stud since in use on a starter it will be electrically connected to a starting switch. The terminal stud 52 may be termed a motor terminal stud since it is electrically connected to the cranking motor when the solenoid is attached to an electric starter. The terminal stud 50 may be termed a return terminal stud.

Figure 5:
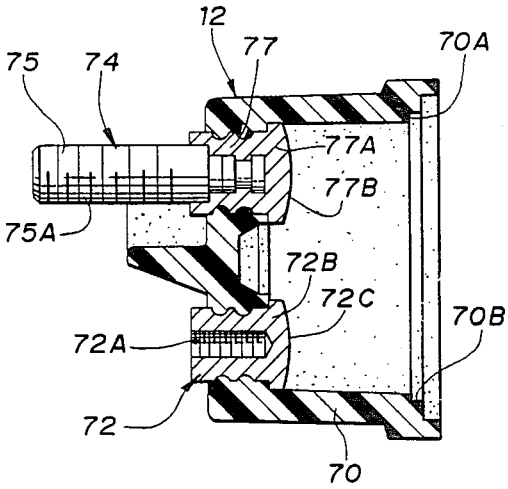
FIG. 5 is a sectional view of a cover assembly which is utilized in the solenoid shown in FIG. 1.

Referring now to FIG. 5, the cover assembly 12 comprises a cover member 70 which is formed of a plastic insulating material. The cover 70 has annular surfaces 70A and 70B. The cover 70 carries a motor terminal 72 and a battery terminal generally designated by reference numeral 74. The battery terminal 74 is comprised of a steel threaded terminal stud 75 which is secured to a copper part 77. This is accomplished by molding one end of steel stud 75 into copper part 77. The stud 75 has a threaded portion 75A. The copper terminal 72 and part 77 are insert molded into the plastic cover 70. The terminal 72 has a threaded bore 72A for receiving a threaded stud. The terminal 72 has a contact portion 72B that has a contact face 72C. Part 77 has a contact portion 77A that has a contact face 77B. The contact faces 72C and 77B are adapted to be engaged by a movable electrical contact in a manner that will be described. The contact portions 77A and 72B have a rectangular or square outline to prevent them from turning.

The manner in which the cover assembly 12 is secured to the case 14 will now be described. When it is desired to secure the cover assembly 12 to the case 14 the terminal studs 50, 52 and 54 are passed through openings in the cover 70 so that the threaded portions of the studs project beyond the outer end surface of the cover 70. During this assembly a rubber 0-ring 76 is assembled such that it engages the outer surface 40A of plate 40 and a curved surface of case 14. With the parts in the position described, nuts 78 and 80 are threaded onto stud 54, a nut 82 is threaded onto stud 52 and a nut 84 is threaded onto stud 50. When these nuts are tightened the cover 70 is tightly secured to the case 14 and the 0-ring 76 is compressed. In securing the nuts to the studs, suitable steel and insulating washers are used. When the cover 70 is assembled to case 14 the surface 70B of cover 70 and outer surface 40A of plate 40 form register surfaces. Thus, the plate 40 operates as a register for cover 70.

Figure 2:
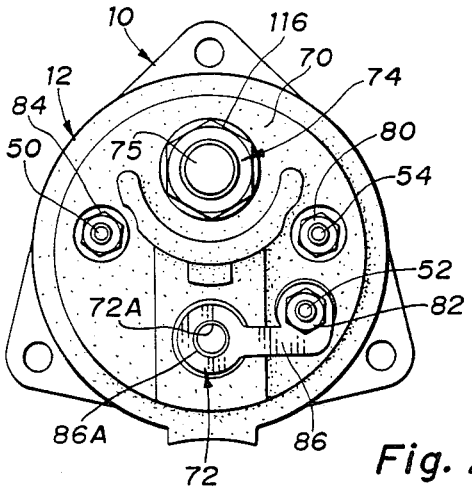
FIG. 2 is an end view of the solenoid shown in FIG. 1 looking in the direction of arrows 2—2.

It should be noted that before the nut 82 is threaded onto the terminal stud 52, a copper connector strap 86 is assembled to stud 52. The connector strap 86 has a hole or opening that receives the terminal stud 52 and has another opening 86A which is aligned with the threaded bore 72A of motor terminal 72. The connector strap 86 therefore serves to electrically connect the motor terminal 72 and the terminal stud 52. The connector strap 86 is held in the position shown in FIG. 2 by nut 82 when it is tightened.

The solenoid shown in FIG. 1 has a plunger or armature 90 which is formed of a magnetic material such as steel. The plunger 90 is secured to a steel plunger shaft 92. The shaft 92 has portions 92A and 92B which have a square or rectangular outline. The portion 92A slides in a bushing 95 which is formed of a plastic bearing material such as nylon. The bushing 95 is a snap-in type of bushing and is supported by central bore surfaces of plunger stop 36. The internal bore configuration of bushing 95 is square or rectangular to prevent turning or rotation of portion 92A of shaft 92.

The portion 92B of shaft 92 carries a part 96 that is formed of plastic insulating material. The portion 92B has a square or rectangular outline which cooperates with a square or rectangular bore of the insulator part 96 to prevent part 96 from rotating or turning relative to portion 92B.

The insulator 96 carries a movable contact or contactor 98 which is formed of copper. The contact 98 has a square or rectangular opening that is complementary to a square or rectangular outer surface of insulator 96 to thereby prevent contact 98 from turning or rotating relative to insulator 96.

The contact 98 is forced against a radial flange of insulator 96 by an overtravel spring 100 that is compressed between an insulating washer 101 and a steel washer 102. A steel washer 103 is located between an end of insulator 96 and a spun-over portion 104 of shaft 92.

The plunger 90 is secured to another shaft 106 that is adapted to be connected to a shift lever mechanism of an electric starter for shifting the pinion. The shaft 106 is enclosed by a rubber boot 108. The shaft 106 carries a pair of retaining rings 110 and 112 and a spring 114 is interposed between these rings.

It will be appreciated that contact 98 and contacts 77A and 72B form a switch means. Contacts 77A and 72B are the fixed contacts of the switch and contact 98 is the movable contact. When plunger 90 is moved b energization of coils 24 and 26 the contact 98 will be moved into engagement with contact faces 77B and 72C to thereby electrically connect terminals 74 and 72. The contact 98 preferably has a rectangular outer configuration and is dimensioned such that it will not engage studs 50, 52 and 54 when it is moved. Putting it another way, there is clearance between the outer marginal edge of contact 98 and the studs. The plunger 90 slides in the bushing 34 and is supported thereby.

When the solenoid is assembled to a cranking motor to provide a complete electric starter the shaft 106 is connected to a shift lever mechanism for shifting the pinion of the starter. The motor terminal 72 is connected to the cranking motor by a strap type of conductor (not illustrated) that has a hole or opening that is aligned with the threaded bore 72A. A threaded stud is now used to secure the strap to terminal 72 with the strap engaging the part of connector 86 that surrounds opening 86A. The stud 75 is adapted to project through an eyelet terminal of a battery cable and to be held in place by a nut 116 that is threaded onto threaded portion 75A of stud 75.

At the expense of some reiteration, it is pointed out that the steel plate 40 acts as a flux path and also as a register for cover 70. This provides good sealing alignment for the 0-ring seal 76 and also provides cover rigidity. In regard to the register aspect, it is seen that surface 70B of cover 70 fits over the outer circular surface 40A of plate 40. Surface 70A abuts an annular surface portion of plate 40. By way of example, and not by way of limitation, the outer diameter of surface 40A may be about 64.9 to 65.1 mm and the inner diameter of annular surface 70B about 65.2 to 65.4 mm.

The embodiments of the invention in which an exclusive property or privilege is claimed are defined as follows:

1. A solenoid switch comprising, a tubular case, a coil support formed of electrical insulating material disposed within said case, at least one coil winding carried by said coil support, a plurality of metallic studs each having an end portion that is insert molded into said coil support whereby said studs are rigidly supported by said coil support, each stud having a threaded portion, a cover formed of electrical insulating material, said studs extending through openings in said cover with the threaded portions of the studs positioned exterior of the cover, nut means threaded onto the threaded portions of said studs for securing said cover to said case, a plunger shiftable relative to said coil support, switch means including movable contact means disposed within said cover and actuated by said plunger, and means electrically connecting an end lead of said coil winding to one of said studs at a point located within said cover.

2. A solenoid switch for an electric starter comprising, a tubular case formed of magnetic material, a coil support formed of electrical insulating material disposed within said case, a pull-in coil and a hold-in coil carried by said coil support, a plurality of metallic studs each having an end portion that is insert molded into said coil support whereby said studs are rigidly supported by said coil support, each stud having a threaded portion, a cover formed of electrical insulating material, said studs extending through openings in said cover with the threaded portions of the studs positioned exterior of the cover, nut means threaded onto the threaded portions of said studs for securing said cover to said case, a plunger shiftable relative to said coil support, switch means including movable contact means disposed within said cover and actuated by said plunger, and means electrically connecting end leads of said pull-in and hold-in coils to said studs at points located within said cover.

3. The solenoid according to claim 2 where the tubular case has an end wall and a plate formed of magnetic material that engages an outer surface of said end wall and is secured to said case, the plate having a circular outer marginal surface and wherein said cover has an inner circular surface that is located adjacent said circular outer marginal surface of said plate, and an 0-ring formed of elastomeric material compressed between said cover and case and disposed about said outer marginal surface of said plate, said plate providing a flux path for flux generated when said coils are energized.

* * * * *